United States Patent [19]

Vartiainen

[11] 4,441,537

[45] Apr. 10, 1984

[54] APPARATUS AND METHOD FOR ALIGNING LUMBER

[75] Inventor: Jorma Vartiainen, Karhula, Finland

[73] Assignee: Plan-Sell Oy, Finland

[21] Appl. No.: 320,701

[22] Filed: Nov. 12, 1981

[30] Foreign Application Priority Data

Nov. 14, 1980 [FI] Finland ..... 80/3564

[51] Int. Cl.[3] ..... B27B 1/00

[52] U.S. Cl. ..... 144/357; 83/367; 83/418; 83/732; 144/378; 144/242 R

[58] Field of Search ..... 144/356, 357, 378, 242 R; 83/367, 418, 421, 732

[56] References Cited

U.S. PATENT DOCUMENTS

| | | | |
|---|---|---|---|
| 3,736,968 | 6/1973 | Mason | 144/357 |
| 3,769,864 | 11/1973 | Morse et al. | 83/367 |
| 3,970,128 | 7/1976 | Kohlberg | 144/357 |
| 4,027,563 | 6/1977 | Weavell | 83/732 |
| 4,281,695 | 8/1981 | Heikinheimo | 144/357 |
| 4,316,491 | 2/1982 | Kearnes et al. | 144/357 |

FOREIGN PATENT DOCUMENTS

| | | | |
|---|---|---|---|
| 2706149 | 8/1978 | Fed. Rep. of Germany | 83/367 |

*Primary Examiner*—W. D. Bray

*Attorney, Agent, or Firm*—McGlew and Tuttle

[57] ABSTRACT

An apparatus for aligning lumber, especially blocks from which the first pair of cants is removed, comprising a conveyor for transferring the blocks in longitudinal direction, a measuring station and a microprocessor or equivalent. Before feeding the blocks into a saw mill, they have to be aligned correctly in order to ascertain a maximum amount of wood products. In conventional apparatuses for aligning blocks, the alignment is performed on the unsawed surfaces of the block. In practice this leads to errors. In the present invention the errors can be eliminated by arranging the aligning members to comprise one or several short conveyors located in connection to the conveyor. The short conveyor can be shifted transversally both below and above the level of the conveyor, and it can be given a horizontal adjusting movement impulse according to the adjusting values received from the calculating unit.

6 Claims, 1 Drawing Figure

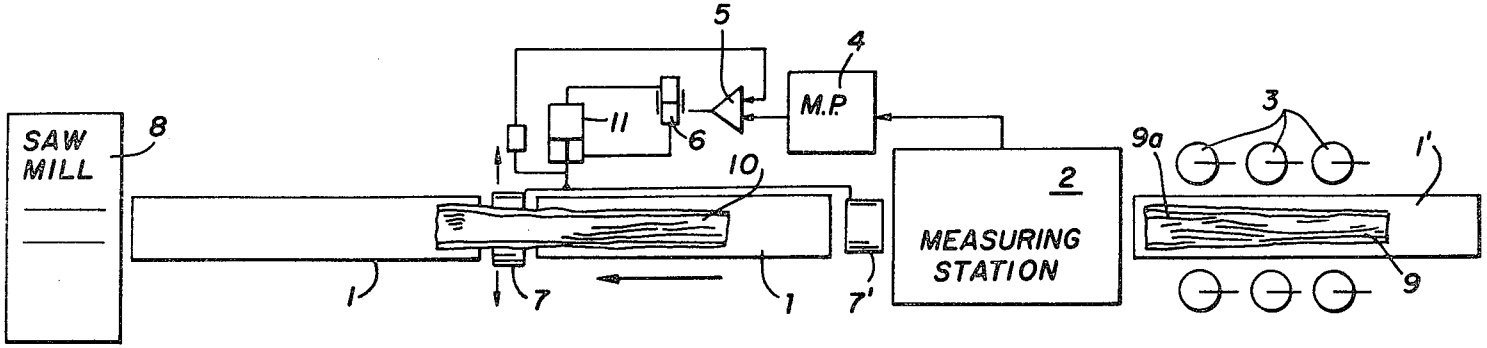
1'
9
3
9a
2
MEASURING STATION
4
M.P.
7'
1
5
10
6
11
7
1
8
SAW MILL

APPARATUS AND METHOD FOR ALIGNING LUMBER

FIELD AND BACKGROUND OF THE INVENTION

The present invention relates to an apparatus for aligning lumber, especially blocks from which the first pair of cants has been removed, the alignment of the lumber taking place before feeding it into a saw mill. The apparatus comprises a conveyor for outlining the sawed surface and the profile of the cant-removed blocks. Such a method is a microprocessor or other equivalent calculating unit for processing the measuring data and for controlling the aligning members.

In the prior art, is known for example a method is known for example for aligning cant-removed blocks before feeding them into a saw mill, presented in the Finnish Patent Application No. 761401. According to this method, the cant-removed blocks are centralized symmetrically with respect to the infeed line, while the blocks are in continuous longitudinal movement. The centralizing is arranged to take place by means of centralizing members, which affect two points at the sides of the cant-removed block. Simultaneously the form of the block is outlined by means of a measuring apparatus connected to a calculator. After the measuring, direction of the block is corrected according to the reading obtained from the calculator.

Among the drawbacks of the aforementioned method is the fact that the aligning of the cant-removed blocks takes place on the uneven, unsawed surfaces. Although the purpose is to carry out the centralizing and the alignment at the same points, the unevenness of the surface easily causes errors. One attempt to avoid this drawback in a preferred embodiment of the above mentioned Finnish Patent Application is an arrangement where the centralizing and the aligning members move along with the block. This, however, leads to complex and expensive constructions.

SUMMARY OF THE INVENTION

The above described drawbacks can be avoided in a construction according to the present invention. One of the most outstanding advantages of the invention is the fact that the aligning takes place by supporting the block at the sawed, even surface. Thus the inaccuracies caused by rough, unsawed surfaces are avoided. Moreover, the alignment of the cant-removed blocks can be performed while the blocks are in continuous, longitudinal movement.

Accordingly, an object of the present invention is to provide an apparatus for aligning lumber, especially blocks from which the first pair of cants has been removed, comprising feeding the lumber on a conveyor in a longitudinal feed direction past a measuring station for measuring the outline of the sawed surface and the profile of the cant removed block, processing the measuring station information in a microprocessor or calculating unit for obtaining a lateral shift amount by which the lumber should be shifted laterally of the longitudinal direction to optimize wood production from the block, and a short conveyor operable transversely to the longitudinal feed direction for shifting an upstream and downstream end of the block by the lateral shift amount.

Another object of the invention is to provide a method of aligning a lumber block from which a first pair of cants has been removed comprising positioning the block on a longitudinal conveyor on one of its sawed surfaces, transporting the block in a feed direction past a measuring station for measuring the outline and profile of the bock, processuring the measured information to obtain a lateral shift amount, and laterally shifting the upstream and downstream end of the block in longitudinal direction by the shift amount.

In the following the invention is described in detail with reference to the appended drawings.

FIG. 1 is a schematic illustration of an arrangement according to the invention, seen from above.

DESCRIPTION OF THE PREFERRED EMBODIMENT

Referring to the drawing, in particular, the invention embodied therein comprises a device for aligning a wood block from which the first pair of cants has been removed to expose upper and lower flat surfaces.

In FIG. 1, the symbolic number 1' refers to a longitudinal conveyor which transfers the cant-removed block 9 in longitudinal position through the measuring station 2. Before the measuring station 2 the block 9 is centralized with respect to the center lines of the conveyor 1' and the measuring station 2. The block with a flat upper surface 9*a* and similar lower surface (not shown), which remain after the cants are removed, rest on conveyor 1' on its lower surface. Number 3 in the drawing refers to the centralizing members.

The measuring station 2 is provided with conventional measuring devices, by the help of which the shape of the cant-removed block and of the sawed surface can be outlined. From the measuring station the obtained data are further transferred to a suitable calculating unit, for example a microprocessor 4. The microprocessor 4 chooses for the block such a position and alignment with respect to the sawing line, that an optimum amount of wood products is obtained when employing appropriate guides in the following sawing phases. The microprocessor 4 is directly connected to the adjusting circuit 5, which controls the servovalve 6. The servovalve 6 is employed for adjusting the hydraulic circuit 11, which moves the roller 7 transversely with respect to the longitudinal conveyor 1. The roller 7 is fitted into the opening of the longitudinal conveyor in such a fashion that the roller 7 can be both lifted above the level of the longitudinal conveyor 1 and lowered below that level.

Normally the roller 7 is located below the level of the conveyor 1. As the front end of the cant-removed block 10 reaches the roller 7, the roller is lifted up so that it simultaneously elevates the front end of the block 10 off the conveyor 1. The lifting movement is not large, in practice only some tens of millimeters. At the same time the roller is shifted a sufficient distance sideways, so that the front end of the cant-removed block 10 is moved to a position conforming to the optimum alignment. Because the shift sideways takes place very rapidly, in a few decimals of a second only, the block has no opportunity of moving much in the longitudinal direction. After the shift sideways, the roller 7 is immediately lowered. As the far end of the block 10 reaches the roller 7, the shifting of the far end is performed in a similar manner. After the block has been thus aligned, it is further transported to the sawing mill 8.

The apparatus according to the invention can also be constructed so that there are several devices to carry out the sideways shift and these devices are arranged in connection to the conveyor 1, at suitable distances from each other. In this case the aligning of both the front end and the far end of the block 10 can be performed simultaneously. For example, a second roller 7' can be provided at the front end of conveyor 1, the roller 7' being also controllable by means 4, 5, 6 and 11. Roller 7 and 7' are individually controlled to move the leading and trailing ends of the block 10, independently. Instead of the roller 7 of the above description, it is possible to use a conveyor of another type, for example a short band conveyor or a flight conveyor. If a flight conveyor is employed, the lifting of the block can also be carried out so that the flight rising from below lifts the block off the longitudinal conveyor 1. Consequently the contact point of the cant-removed block and the side shift device does not change, except in the case of the roller 7.

Rollers 7 or 7', or the short band conveyor or flight conveyor referred to above, are here collectively referred to as lateral shifting means which have the capacity to move laterally of the feed direction for the conveyors 1 and 1', as well as momentarily rise above an effective support surface of the conveyor 1 for effecting a lateral shifting function of either the leading or the trailing ends of a block, indepedently so that the block can be shifted in any desired manner on conveyor 1.

The various features of novelty which characterize the invention are pointed out with particularlity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

I claim:

1. A method for aligning lumber block from which a first pair of cants has been removed to leave upper and lower flat surfaces, comprising:

positioning the block with its lower surface on a longitudinal conveyor for transporting the block in a longitudinal feed direction;

feeding the block past a measuring station in the longitudinal direction which measures the outline of the lower surface and contour of the block to obtain a measurement thereof;

processing the measurement in a microprocessor to obtain a lateral shift amount for an upstream and a downstream end of the block in the longitudinal feed direction by which the block should be shifted to optimize wood production from the block;

laterally shifting the upstream end of the block using a lateral shift conveyor operable in a direction lateral to the longitudinal feed direction to momentarily lift and shift the upstream end by the lateral shift amount for the upstream end;

laterally shifting the downstream end of the block using a lateral shift conveyor operable in a direction lateral of the longitudinal feed direction to momentarily lift and shift the downstream end by the lateral shift amount of the downstream end;

the lateral shifting of the up and downstream ends being spaced in at least one of time, amount and position; and feeding the laterally shifted block in the longitudinal feed direction to a saw mill.

2. A method according to claim 1, wherein, prior to positioning the block on the longitudinal conveyor, the lumber block is cut parallel to its longitudinal axis to remove the first pair of cants therefrom to leave upper and lower flat surfaces thereon.

3. A device for aligning a lumber block from which a first pair of cants has been removed to leave upper and lower flat surfaces, the block also having an outer contour, comprising:

longitudinal conveyor means for conveying the block in a longitudinal feed direction, the block having an upstream end and a downstream end in the feed direction;

measuring means positioned along the longitudinal feed direction for measuring an outline of the lower flat surface of the block and the outer contour of the block to obtain a measurement therefrom and to generate a lateral shift amount for shifting each of the upstream end and the downstream end of the block in the feed direction to optimize wood production from the block; and lateral shifting means positioned in the lateral feed direction and downstream of said measuring means, and connected to said measuring means for laterally shifting each of the upstream and downstream ends of the block by the lateral shift amount for the upstream and the downstream ends;

said lateral shifting means being operable to momentarily lift each of the upstream and downstream ends of the block above said lateral conveyor means for laterally shifting each of the upstream and downstream ends by the lateral shift amount independently of each other.

4. A device according to claim 3, including centering means positioned upstream of said measuring means for centering the block on said longitudinal conveyor.

5. A device according to claim 1 wherein said lateral shifting means comprises at least one roller rotatably mounted with respect to said longitudinal conveyor means and control means for rotating said at least one roller to shift at least one of the upstream and downstream ends of the block by the lateral shift amount, and to lift and lower said at least one roller momentarily raising at least one of the upstream and downstream ends of the block.

6. A device according to claim 5 wherein said lateral shifting means includes an additional roller rotatably mounted with respect to said longitudinal conveyor means and space said former mentioned at least one roller in said longitudinal feed direction, said additional roller connected to said control means for laterally shifting and momentarily raising at least one of the upstream and downstream ends of the block.

* * * * *

UNITED STATES PATENT OFFICE

CERTIFICATE OF CORRECTION

Patent No. 4,441,537 Dated April 10, 1984

Inventor(s) Vartiainen

It is certified that error appears in the above-identified patent and that said Letters Patent are hereby corrected as shown below:

Assignee is A. AHLSTROM OSAKEYHTIO, of 48601 Karhula, Finland and not Plan-Sell Oy, of Helsinki, Finland.

Signed and Sealed this

*Eighteenth* Day of *September 1984*

[SEAL]

*Attest:*

GERALD J. MOSSINGHOFF

*Attesting Officer*

*Commissioner of Patents and Trademarks*